US010027093B2

(12) United States Patent
Kobayashi et al.

(10) Patent No.: US 10,027,093 B2
(45) Date of Patent: Jul. 17, 2018

(54) SPARK PLUG

(71) Applicant: NGK SPARK PLUG CO., LTD., Nagoya-shi, Aichi (JP)

(72) Inventors: Tsutomu Kobayashi, Inazawa (JP); Keiji Ozeki, Konan (JP)

(73) Assignee: NGK SPARK PLUG CO., LTD., Aichi (JP)

( * ) Notice: Subject to any disclaimer, the term of this patent is extended or adjusted under 35 U.S.C. 154(b) by 0 days.

(21) Appl. No.: 15/561,827

(22) PCT Filed: Mar. 28, 2016

(86) PCT No.: PCT/JP2016/001789

§ 371 (c)(1),
(2) Date: Sep. 26, 2017

(87) PCT Pub. No.: WO2016/174816

PCT Pub. Date: Nov. 3, 2016

(65) Prior Publication Data

US 2018/0123323 A1 May 3, 2018

(30) Foreign Application Priority Data

Apr. 28, 2015 (JP) ..... 2015-090920

(51) Int. Cl.
*H01T 13/20* (2006.01)
*H01T 21/02* (2006.01)
(Continued)

(52) U.S. Cl.
CPC ..... *H01T 13/34* (2013.01); *H01T 13/36* (2013.01)

(58) Field of Classification Search
CPC ..... H01T 13/20; H01T 21/02; H01T 13/39
See application file for complete search history.

(56) References Cited

U.S. PATENT DOCUMENTS 5,095,242 A 3/1992 Richeson ..... 313/143
2001/0002096 A1 5/2001 Honda et al. ..... 313/143
(Continued)

FOREIGN PATENT DOCUMENTS

JP H04-229979 A 8/1992
JP 2001-155839 A 6/2001
(Continued)

OTHER PUBLICATIONS

International Search Report issued in corresponding International Patent Application No. PCT/JP2016/001789, dated Jun. 14, 2016.
(Continued)

*Primary Examiner* — Joseph L Williams
(74) *Attorney, Agent, or Firm* — Kusner & Jaffe

(57) ABSTRACT

A spark plug includes an insulator having an axial hole formed in a direction of an axis, a center electrode held in one end side of the axial hole, a metal terminal held in the other end side of the axial hole, an electrical connection part arranged to establish electrical connection between the center electrode and the metal terminal within the axial hole, and a metal shell disposed around an outer circumference of the insulator and having a thread portion formed on at least a part of an outer circumferential surface thereof. The electrical connection part has a resistor, and a conductive seal layer provided between the resistor and the center electrode to seal and fix the insulator and the center electrode together. In a half or more of a region in which the seal layer is provided in the direction of the axis, the spark plug satisfies predetermined conditions.

4 Claims, 8 Drawing Sheets

(51) Int. Cl.

| | |
|---|---|
| ***H01T 13/39*** | (2006.01) |
| ***H01T 13/34*** | (2006.01) |
| ***H01T 13/36*** | (2006.01) |

(56) References Cited

U.S. PATENT DOCUMENTS

| | | | | |
|---|---|---|---|---|
| 2008/0074025 | A1 | 3/2008 | Hori | 313/141 |
| 2015/0188294 | A1 | 7/2015 | Nishida et al. | |

FOREIGN PATENT DOCUMENTS

| | | | |
|---|---|---|---|
| JP | 2008-077838 | A | 4/2008 |
| JP | 2011-222242 | A | 11/2011 |
| KR | 2015-0036498 | A | 4/2015 |

OTHER PUBLICATIONS

Japanese Industrial Standard, JIS B 8031: 2006. International Combustion Engines—Spark-Plugs.

Official Action received in corresponding Korean Patent Application No. 10-2017-7030754, dated Mar. 3, 2018 (machine translation provided).

FIG. 3

| Sample No. | Thread Size M | Thickness *a* of Insulator | Thickness *b* of Air Layer | Inter-electrode Distance *a* + *b* | *a*/(*a* + *b*) ×100 | Reduction Rate (%) | Evaluation Result | |
|---|---|---|---|---|---|---|---|---|
| 1 | 14 | 2.65 | 0.15 | 2.80 | 5.4 | 0.0 | — | |
| 2 | 14 | 2.63 | 0.17 | 2.80 | 6.1 | 1.8 | △ | |
| 3 | 14 | 2.58 | 0.22 | 2.80 | 7.9 | 4.6 | △ | |
| 4 | 14 | 2.57 | 0.23 | 2.80 | 8.2 | 5.3 | ○ | ← *s* |
| 5 | 14 | 2.55 | 0.25 | 2.80 | 8.9 | 6.5 | ○ | |
| 6 | 14 | 2.50 | 0.30 | 2.80 | 10.7 | 8.4 | ○ | |
| 7 | 14 | 2.45 | 0.35 | 2.80 | 12.5 | 9.2 | ○ | |
| 8 | 14 | 2.40 | 0.40 | 2.80 | 14.3 | 10.8 | ◎ | |
| 9 | 14 | 2.36 | 0.44 | 2.80 | 15.7 | 11.6 | ◎ | |
| 10 | 12 | 1.70 | 0.10 | 1.80 | 5.6 | 0.0 | — | |
| 11 | 12 | 1.68 | 0.12 | 1.80 | 6.7 | 2.6 | △ | |
| 12 | 12 | 1.65 | 0.15 | 1.80 | 8.3 | 5.9 | ○ | ← *t* |
| 13 | 12 | 1.62 | 0.18 | 1.80 | 10.0 | 8.8 | ○ | |
| 14 | 12 | 1.61 | 0.19 | 1.80 | 10.6 | 10.5 | ◎ | |
| 15 | 12 | 1.58 | 0.22 | 1.80 | 12.2 | 14.2 | ◎ | |
| 16 | 12 | 1.55 | 0.25 | 1.80 | 13.9 | 15.9 | ◎ | |
| 17 | 12 | 1.49 | 0.31 | 1.80 | 17.2 | 17.5 | ◎ | |
| 18 | 10 | 1.65 | 0.10 | 1.75 | 5.7 | 0.0 | — | |
| 19 | 10 | 1.63 | 0.12 | 1.75 | 6.9 | 3.7 | △ | |
| 20 | 10 | 1.60 | 0.15 | 1.75 | 8.6 | 6.9 | ○ | ← *u* |
| 21 | 10 | 1.58 | 0.17 | 1.75 | 9.7 | 9.8 | ○ | |
| 22 | 10 | 1.57 | 0.18 | 1.75 | 10.3 | 11.5 | ◎ | |
| 23 | 10 | 1.53 | 0.22 | 1.75 | 12.6 | 17.2 | ◎ | |
| 24 | 10 | 1.45 | 0.30 | 1.75 | 17.1 | 19.9 | ◎ | |

| Sample No. | *L1/L* | Reduction Rate (%) | Evaluation Result |
|---|---|---|---|
| 30 | 0.2 | 1 | △ |
| 31 | 0.3 | 1.2 | △ |
| 32 | 0.4 | 2.3 | △ |
| 33 | 0.5 | 5.3 | ○ ← *s* |
| 34 | 0.6 | 8 | ○ |
| 35 | 0.8 | 9.5 | ○ |
| 36 | 1 | 10.4 | ◎ |

FIG. 6

| Sample No. | Thread Size M | Thickness $a$ of Insulator | Thickness $b$ of Air Layer | Inter-electrode Distance $a+b$ | $a/(a+b)$ ×100 | Reduction Rate (%) | Evaluation Result | |
|---|---|---|---|---|---|---|---|---|
| 40 | 14 | 2.45 | 0.22 | 2.67 | 8.2 | 4.1 | △ | |
| 41 | 14 | 2.57 | 0.23 | 2.80 | 8.2 | 5.3 | ○ | ← s |
| 42 | 14 | 2.67 | 0.24 | 2.91 | 8.2 | 8.0 | ○ | |
| 43 | 14 | 2.71 | 0.24 | 2.95 | 8.2 | 10.2 | ◎ | |
| 44 | 14 | 2.90 | 0.26 | 3.16 | 8.2 | 12.0 | ◎ | |
| 45 | 12 | 1.54 | 0.14 | 1.68 | 8.3 | 3.8 | △ | |
| 46 | 12 | 1.65 | 0.15 | 1.80 | 8.3 | 5.9 | ○ | ← t |
| 47 | 12 | 1.70 | 0.15 | 1.85 | 8.3 | 8.2 | ○ | |
| 48 | 12 | 1.79 | 0.16 | 1.95 | 8.3 | 10.5 | ◎ | |
| 49 | 12 | 2.00 | 0.18 | 2.18 | 8.3 | 13.5 | ◎ | |
| 50 | 10 | 1.48 | 0.14 | 1.62 | 8.6 | 4.6 | △ | |
| 51 | 10 | 1.60 | 0.15 | 1.75 | 8.6 | 6.9 | ○ | ← u |
| 52 | 10 | 1.71 | 0.16 | 1.87 | 8.6 | 9.6 | ○ | |
| 53 | 10 | 1.74 | 0.16 | 1.90 | 8.6 | 10.9 | ◎ | |
| 54 | 10 | 1.92 | 0.18 | 2.10 | 8.6 | 15.3 | ◎ | |

SPARK PLUG

RELATED APPLICATIONS

This application is a National Stage of International Application No. PCT/JP16/01789 filed Mar. 28, 2016, which claims the benefit of Japanese Patent Application No. 2015-090920, filed Apr. 28, 2015, the entire contents of which are incorporated herein by reference.

FIELD OF THE INVENTION

The present invention relates to a spark plug.

BACKGROUND OF THE INVENTION

In recent years, there is a tendency to increase the combustion pressure in vehicle engines for high power output and fuel efficiency improvement. Consequently, the voltage required of spark plugs of the engines at ignition tends to become high. The rate of wear of electrodes of the spark plugs increases with increase in the voltage required of the spark plugs at the ignition. It has thus been demanded to develop techniques for suppressing wear of the electrodes of the spark plugs.

Conventionally known is a technique to provide noble metal tips on opposed surfaces of the center and ground electrodes of the spark plug for suppression of wear of the electrodes of the spark plugs (see, for example, Japanese Laid-Open Patent Publication No. 2008-77838).

Depending on the voltage required of the spark plug, however, there may occur melting of the noble metal tips themselves. There has accordingly been a demand for a technique to suppress wear of the electrodes irrespective of the materials of the electrodes.

SUMMARY OF THE INVENTION

The present invention has been made to address the above problems and can be embodied as follows.

(1) According to one aspect of the invention, there is provided a spark plug comprising: an insulator having an axial hole formed in a direction of an axis of the spark plug; a center electrode held in one end side of the axial hole; a metal terminal held in the other end side of the axial hole; an electrical connection part arranged to establish electrical connection between the center electrode and the metal terminal within the axial hole; and a metal shell disposed around an outer circumference of the insulator and having a thread portion formed on at least a part of an outer circumferential surface thereof, wherein the electrical connection part includes: a resistor; and a conductive seal layer provided between the resistor and the center electrode to seal and fix the insulator and the center electrode together; and wherein, in a half or more of a region in which the seal layer is provided in the direction of the axis, the spark plug satisfies the following conditions: $a/(a+b)\times100\geq8.2$ and $a+b\geq2.80$ in the case of M14; $a/(a+b)\times100\geq8.3$ and $a+b\geq1.80$ in the case of M12; and $a/(a+b)\times100\geq8.6$ and $a+b\geq1.75$ in the case of M10, where M represents a nominal diameter of the thread portion; a represents a distance between the insulator and the metal shell; and b represents a thickness of the insulator.

In this case, it is possible to lower the capacitance of the spark plug in the region L and thereby possible to suppress wear of the center and ground electrodes of the spark plug.

(2) In accordance with a second aspect of the present invention, there is provided a spark plug as described above, wherein the spark plug may be configured to satisfy the following conditions: $a+b\geq2.95$ in the case of M14; $a+b\geq1.95$ in the case of M12; and $a+b\geq1.90$ in the case of M10.

In this case, it is possible to more effectively suppress wear of the center and ground electrodes of the spark plug.

(3) In accordance with a third aspect of the present invention, there is provided a spark plug as described above, wherein the spark plug may be configured to satisfy the conditions throughout the entire region in which the seal layer is provided.

In this case, it is possible to more effectively suppress wear of the center and ground electrodes of the spark plug.

(4) In accordance with a fourth aspect of the present invention, there is provided a spark plug as described above, wherein the spark plug may be configured such that the nominal diameter of the thread portion is M10 or M12.

In this case, it is possible to more effectively suppress wear of the center and ground electrodes of the spark plug.

It should be noted that the present invention can be embodied in various forms such as a method of manufacturing a spark plug.

BRIEF DESCRIPTION OF DRAWINGS

FIG. 3 is a diagram showing a relationship between the parameters a and b and the reduction rate of the spark plug.

FIG. 6 is a diagram showing a relationship between the parameters a and b and the reduction rate (%) of the spark plug.

DETAILED DESCRIPTIONS OF THE PREFERRED EMBODIMENTS

A. Embodiment

A-1. Structure of Spark Plug

Figure 1:
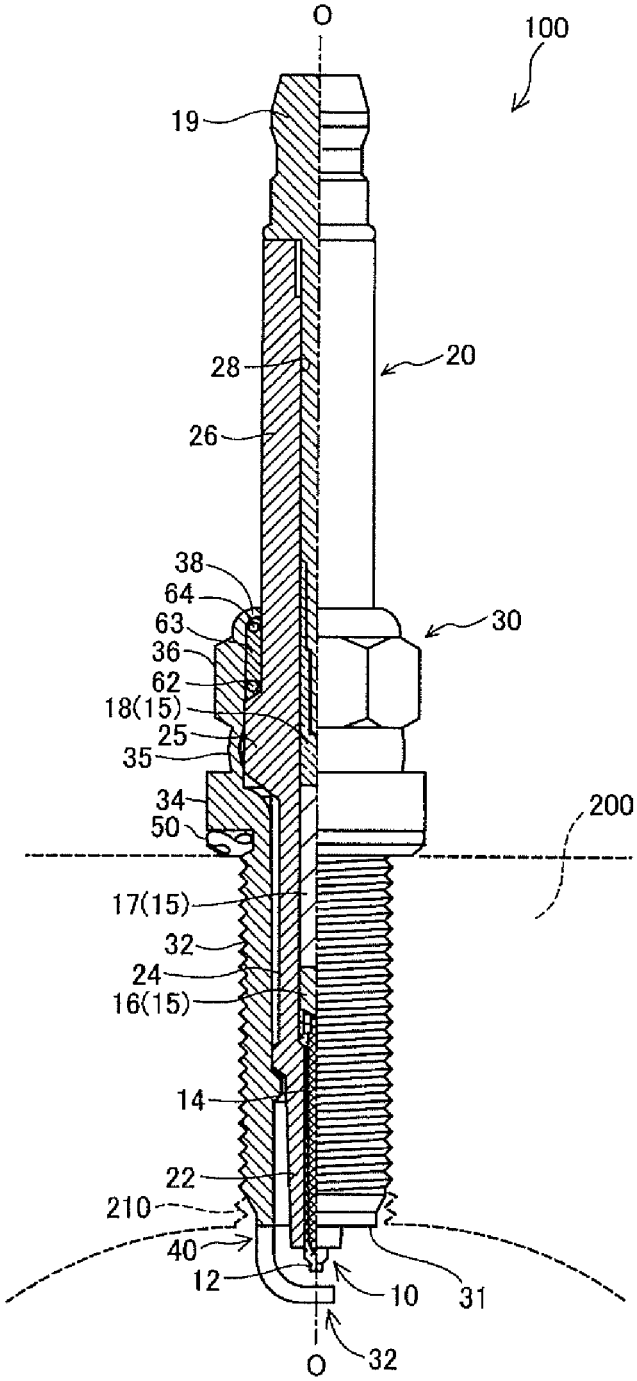
FIG. 1 is a schematic view, partially in section, of a spark plug 100 according to one embodiment of the present invention.

FIG. 1 is a schematic view, partially in section, of a spark plug 100 according to one embodiment of the present invention. In FIG. 1, a center axis of the spark plug 100 is indicated as an axis O-O. The one side of FIG. 1 with respect to the axis O-O shows an appearance of the spark plug 100, whereas the other side of FIG. 1 with respect to the axis O-O shows a cross section of the spark plug 100. The spark plug 100 includes an insulator 20 having an axial hole 28 formed in the direction of the axis O-O, a center electrode 10 held in one end side of the axial hole 28, a metal terminal 19 held in the other end side of the axial hole 28, an electrical connection part 14 arranged to establish electrical connection between the center electrode 10 and the metal terminal 19 within the axial hole 28, and a metal shell 30 disposed around an outer circumference of the insulator 20 and accommodating therein at least a part of the insulator 20. In the present embodiment, the axis O-O of the spark plug 100 coincides with each of axes of the center electrode 10, the insulator 20 and the metal shell 30.

In the spark plug 100, the center electrode 10 is electrically insulated by the insulator 20. The metal shell 30 is fixed by crimping to the outer circumference of the insulator 20 while being kept insulated from the center electrode 10. A ground electrode 40 is electrically connected to the metal shell 30. There is defined a spark gap for generation of spark discharges between the center electrode 10 and the ground electrode 40. The spark plug 100 is mounted to an engine head 200 of an internal combustion engine (not shown) by screwing the metal shell 30 into a mounting screw hole 210 of the engine head 200. When a high voltage of 20,000 to 30,000 volts is applied to the center electrode 10, a spark discharge is generated in the spark gap between the center electrode 10 and the ground electrode 40.

The center electrode 10 of the spark plug 100 is formed in a rod shape, and includes a bottomed cylindrical-shaped electrode base material 12 and a core material 14 embedded in the electrode base material 12 and having a higher thermal conductivity than that of the electrode base material 12. The center electrode 10 is fixed in the insulator 20, with a front end of the electrode base material 12 protruding from one end of the insulator 20, and is electrically connected to the metal terminal 19 via the electrical connection part 15. In the present embodiment, a nickel alloy containing nickel as main component, such as Inconel (trademark), is used as the electrode base material 12; and copper or an alloy containing copper as main component is used as the core material 14.

The electrical connection part 15 has a first seal layer 16, a resistor 17 and a second seal layer 18 arranged in this order from the side of the center electrode 10. The first seal layer 16 is provided to seal and fix the insulator 20 and the center electrode 10 together, whereas the second seal layer 18 is provided to seal and fix the insulator 20 and the metal terminal 10 together. In the present embodiment, the resistor 17 is a ceramic resistor formed of a composition containing a conductive material, glass particles and ceramic particles other than the glass particles; and each of the first seal layer 16 and the second seal layer 18 is formed of a mixture of a glass material and a metal powder containing one kind or two or more kinds of metals such as Cu, Sn and Fe as main component. A powder of semiconductive inorganic compound such as $TiO_2$ may be added in an appropriate amount to each of the first seal layer 16 and the second seal layer 18 as needed.

The insulator 20 of the spark plug 200 is formed by firing an insulating ceramic material such as alumina. The insulator 20 is cylindrical in shape, with the axial hole 28 formed therein to hold the center electrode 10, and includes a leg portion 22, a first insulator body portion 24, an insulator collar portion 25 and a second insulator body portion 26 arranged in this order along the axis O-O from the side from which the center electrode 10 protrudes. The leg portion 22 of the insulator 20 has a cylindrical shape that decreases in outer diameter toward the side from which the center electrode 10 protrudes. The first insulator body portion 24 of the insulator 20 has a cylindrical shape larger in outer diameter larger than the leg portion 22. The insulator collar portion 25 of the insulator 20 has a cylindrical shape larger in outer diameter than the first insulator body portion 24. The second insulator body portion 26 of the insulator 20 has a cylindrical shape smaller in outer diameter than the insulator collar portion 25, and is adapted to ensure a sufficient insulation distance between the metal shell 30 and the metal terminal 19.

The metal shell 30 of the spark plug 100 is formed of low carbon steel with a nickel plating in the present embodiment. Alternatively, the metal shell 30 may be formed of low carbon steel with a zinc plating or formed of a nickel alloy with no plating. The metal shell 30 includes an end face 31, a thread portion 32, a body portion 34, a recessed portion 35, a tool engagement portion 36 and a crimp portion 38 arranged in this order along the axis O-O from the side from which the metal electrode 10 protrudes.

The end face 31 of the metal shell 30 is formed in a hollow circular shape on a front end of the thread portion 32. The ground electrode 40 is joined to the end face 31. A part of the center electrode 10 surrounded by the leg portion 22 of the insulator 20 protrudes from the center of the end face 31. The thread portion 32 of the metal shell 30 is provided, on a part of an outer circumferential surface of the metal shell 30, with a screw thread screwed in the mounting screw hole 210 of the engine head 200. The body portion 34 of the metal shell 30 is provided adjacent to the recessed portion 35 so as to protrude more toward the outer circumferential side than the recessed portion 35.

The recessed portion 35 of the metal shell 30 is formed between the body portion 34 and the tool engagement portion 36 by being compression deformed in outer and inner circumferential directions during crimping of the metal shell 30 onto the insulator 20. The tool engagement portion 36 of the metal shell 30 is provided adjacent to the recessed portion 35 as a collar portion so as to protrude more toward the outer circumferential side than the recessed portion 35 and is formed in a polygonal shape engageable with a tool (not shown) for mounting the spark plug 100 onto the engine head 200. Although the tool engagement portion 36 is of hexagonal shape in the present embodiment, the tool engagement portion 36 may be of any other polygonal shape such as rectangular or octagonal shape. The crimp portion 38 of the metal shell 30 is formed adjacent to the tool engagement portion 36 by being plastic deformed and thereby brought into intimate contact with the second insulator body portion 26 of the insulator 20 during crimping of the metal shell 30 onto the insulator 20. In a region between the crimp portion 38 of the metal shell 30 and the insulator collar portion 25 of the insulator 20, there is a filled portion 63 filled with a powdery talc (talc powder) and sealed by packings 62 and 64.

The ground electrode 40 of the spark plug 100 is joined by welding to the metal shell 30 and is bent to a direction intersecting the axis O-O so as to face the front end of the center electrode 10. In the present embodiment, the ground electrode 40 is formed of a nickel alloy containing nickel as main component, such as Inconel (trademark).

Figure 2:
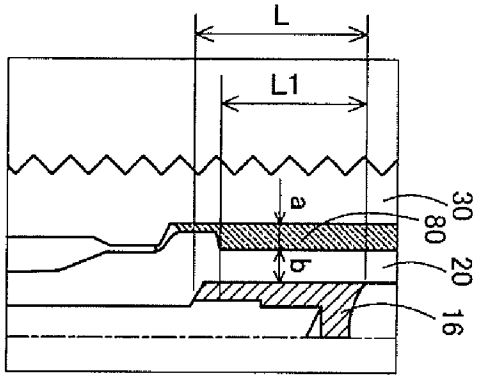
FIG. 2 is an enlarged cross-sectional view of part of the spark plug 100.

FIG. 2 is an enlarged cross-sectional view of part of the spark plug 100 taken along the axis O-O. Namely, a cross section of the spark plug 100 including the axis O-O is shown in FIG. 2. In FIG. 2, the first seal layer 16, the insulator 20 and the metal shell 30 are shown in enlargement. There is a space left between the insulator 20 and the metal shell 30. This space is called an air layer 80 because air is present in this space. In FIG. 2, "a" represents a thickness of the air layer 80 between the insulator 20 and the metal shell 30, that is, a distance between the insulator 20 and the metal shell 30 (in units of mm); and "b" represents a thickness of the insulator 20 (in units of mm). Herein, the term "thickness" refers to a dimension in a direction perpendicular to the axis O-O. A region in which the first seal layer 16 is provided in the direction of the axis O-O is designated as L. Among the region L, a zone in which the following conditions (numerical formulas (1) to (3)) are satisfied is designated as L1. Further, "M" represents a nominal diameter (also referred to as "thread size") of the thread portion 32. In the following description, the parameter "a/(a+b)×100" is also called "air layer ratio"; and the parameter "a+b" is also called "inter-electrode distance".

$$\text{In the case of } M=14 \text{ mm, } a/(a+b)\times 100 \geq 8.2 \text{ and } a+b \geq 2.80 \quad (1)$$

$$\text{In the case of } M=12 \text{ mm, } a/(a+b)\times 100 \geq 8.3 \text{ and } a+b \geq 1.80 \quad (2)$$

$$\text{In the case of } M=10 \text{ mm, } a/(a+b)\times 100 \geq 8.6 \text{ and } a+b \geq 1.75 \quad (3)$$

In the present embodiment, the zone L1 occupies a half or more of the region L. The capacitance of the spark plug in the region L is effectively decreased by this configuration control. The hypothetical mechanism of capacitance decrease will be explained in detail later. Consequently, the capacitive energy of the spark plug 100 is reduced so that it is possible to suppress wear of the center electrode 10 and the ground electrode 40 irrespective of the materials of the center electrode 10 and the ground electrode 40. Hereinafter, an explanation will be given of experimental results for verifying these effects.

A-2. Experimental Results

FIG. 3 is a diagram showing a relationship between the parameters a and b and the reduction rate. First, samples of spark plugs with varying combinations of a and b were produced by forming a plurality of metal shells with different thread sizes and cutting away outer circumferences of insulators. An experiment was then performed on the respective samples under the following conditions. In each sample, the zone L1 was set to occupy a half of the region L; and the parameters a and b were respectively set to constant values as shown in FIG. 2. As the measurement conditions, the spark plugs were each subjected to 100 times of ignition per second (100 Hz) for 5 hours in an air atmosphere under a pressure of 2.6 MPa. After that, the spark plugs were cut along the axis O-O. In the cross section of each spark plug, the parameters a and b were measured at both sides of the axis O-O. An average value of the measurement results was determined. The average parameter values of the respective spark plugs are listed in FIG. 3. The "reduction rate (%)" refers to a rate of reduction of the amount of wear of the electrode relative to that of a conventional spark plug, as determined by the following formula.

$$\{1-(\text{Increase of Gap between Electrodes of Sample Spark Plug}/\text{Increase of Gap between Electrodes of Conventional Spark Plug})\}\times 100 \quad (4)$$

The larger the increase of gap between the electrodes after the experiment, the larger the amount of wear of the electrodes. Thus, the higher the reduction rate (%), the smaller the amount of wear of the electrodes relative to that of the conventional spark plug. The evaluation results of the respective spark plugs are indicated with "◎, ○, Δ" according to the following criteria. The spark plug whose evaluation result is indicated with "-" corresponds to the conventional spark plug used as the sample for comparison.

Reduction rate of lower than 5%: Δ

Reduction rate of 5% or higher and lower than 10%: ○

Reduction rate of 10% or higher: ◎

It is apparent from the results of FIG. 3 that it is possible to improve the reduction rate, i.e., possible to suppress wear of the electrodes by satisfaction of the numerical formulas (1) to (3). More specifically, the spark plugs of sample No. 4 to 9, 12 to 17 and 20 to 24 satisfying the numerical formulas (1) to (3) had a reduction rate of 5% or higher as shown in FIG. 3.

Figure 4:
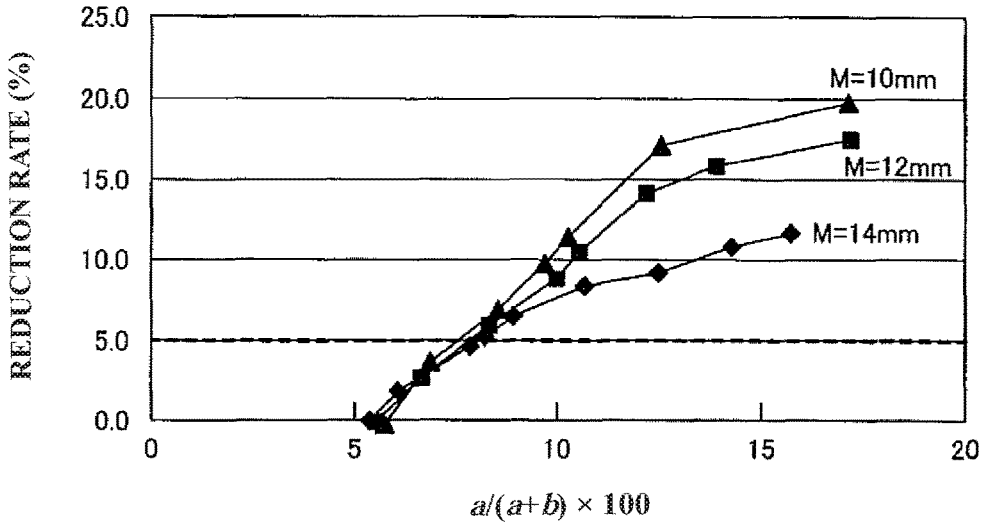
FIG. 4 is a diagram showing a relationship between the air layer ratio and the reduction rate (%) of the spark plug.

FIG. 4 is a diagram showing a relationship between the air layer ratio (a/(a+b)×100) and the reduction rate (%). In FIG. 4, the air layer ratio (a/(a+b)×100) is plotted on the horizontal axis; and the reduction rate (%) is plotted on the vertical axis. Further, the experimental result data of the spark plugs with a thread size M of 10 mm are plotted as "▲"; the experimental result data of the spark plugs with a thread size M of 12 mm are plotted as "■"; and the experimental result data of the spark plugs with a thread size M of 14 mm are plotted as "◆" in FIG. 4.

As is seen from the results of FIG. 4, the higher the ratio of the thickness a of the air layer to the inter-electrode distance (a+b), the higher the reduction rate, the more the wear of the electrodes was suppressed, although there was some difference in tendency depending on the thread size. In particular, the smaller the thread size, the more contribution the ratio of the thickness a of the air layer made to the improvement of the reduction rate. It is apparent from these results that it is possible to more improve the reduction rate in the case where the thread size M is 10 mm or 12 mm. From the viewpoint of ensuring the strength of the spark plug, the parameter a/(a+b) is preferably lower than 0.5.

Figures 5A, 5B:
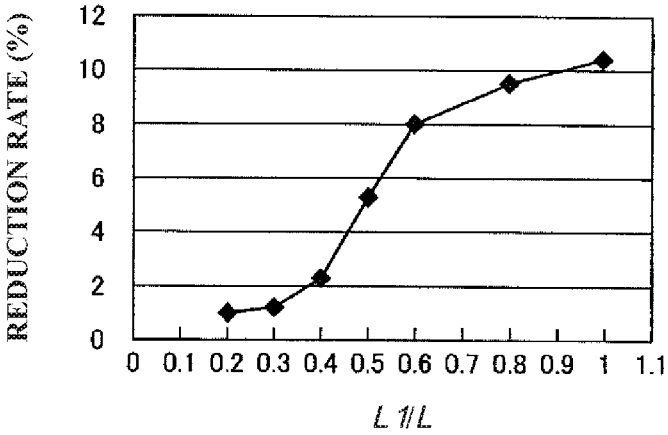
FIGS. 5(A) and 5(B) are diagrams showing a relationship between the proportion of a zone L1 in a region L and the reduction rate (%) of the spark plug.

FIGS. 5(A) and 5(B) are diagrams showing a relationship between the proportion of the zone L1 in the region L (L1/L) and the reduction rate (%). Samples of spark plugs ware produced by, while setting the parameters a and b to the same values as those of the sample s (sample No. 4) in FIG. 3, adjusting the proportion of the zone L1 in the region L (L1/L). In FIG. 5(A), the relationship between the proportion of the zone L1 in the region L (L1/L) and the reduction rate (%) is shown along with the evaluation results. In FIG. 5(B), the proportion of the zone L1 in the region L (L1/L) is plotted on the horizontal axis; and the reduction rate (%) is plotted on the vertical axis.

As is seen from the results of FIGS. 5(A) and 5(B), the spark plug had a reduction rate of 5% or higher when the parameter L1/L was 0.5 or higher, that is, the zone L1 occupied a half or more of the region L (sample No. 33 to 36). As is also seen from the results of FIG. 5(B), the reduction rate was suddenly changed in the range L1/L from 0.4 to 0.6. It is apparent from these results that the parameter L1/L is 0.5 or higher from the viewpoint of improving the reduction rate. The parameter L1/L is more preferably 0.6 or higher, most preferably 1 (L=LP.

FIG. 6 is a diagram showing a relationship between the parameters a and b and the reduction rate (%) with no changes in the air layer ratio (a/(a+b)×100). Samples of spark plugs were produced by adjusting the parameters a and b while setting the air layer ratio (a/(a+b)×100) to the same value as that of the sample s (sample No. 4) in FIG. 3 in the case of M=14 mm, to the same value as that of the sample t (sample No. 12) in FIG. 3 in the case of M=12 mm and to the same value as that of the sample u (sample No. 20) in FIG. 3 in the case of M=14 mm.

It is apparent from the results of FIG. 6 that it is possible to further improve the reduction rate (%) by satisfaction of the following conditions (numerical formulas (5) to (7)).

$$\text{In the case of } M=14 \text{ mm, } a+b \geq 2.95 \quad (5)$$

$$\text{In the case of } M=12 \text{ mm, } a+b \geq 1.95 \quad (6)$$

$$\text{In the case of } M=10 \text{ mm, } a+b \geq 1.90 \quad (7)$$

More specifically, the spark plugs of sample No. 43 to 44, 48 to 49 and 53 to 54 satisfying the numerical formulas (5) to (7) had a reduction rate of 10% or higher as shown in FIG. 6.

A-3. Estimated Mechanism

The estimated mechanism of improving the reduction rate (%) by controlling the parameters L1/L2, a, b and M to within the respective specific ranges will be explained below.

Figure 7:
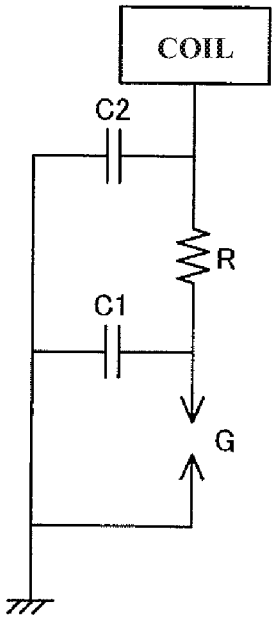
FIG. 7 is a schematic view of an equivalent circuit of the spark plug 100.

FIG. 7 is a schematic view of an equivalent circuit of the spark plug 100. The spark plug 100 can be regarded as a capacitor. An electrical charge accumulated in the spark plug 100 flows through the gap at the time of discharge. Accordingly, the discharge energy (capacitive current) of the spark plug is reduced by lowering the capacitance of the spark plug 100. It is assumed that, as a result of such reduction in energy, it is possible to suppress wear of the center electrode 10 and the ground electrode 40. In FIG. 7, a part of the spark plug situated nearer to the center electrode 10 than the interface between the resistor 17 and the first seal layer 16 (see FIG. 1) is indicated as a capacitor C1; and a part of the spark plug situated near to the metal terminal 19 than the interface between the resistor 17 and the first seal layer 16 is indicated as a condenser C2. The internal resistance of the resistor 17 is indicated as a resistor R. Furthermore, the gap between the center electrode 10 and the ground electrode 40 is designated as G in FIG. 7.

The current from the capacitor C2 largely decreases in value by passing through the resistor R. On the other hand, the current from the capacitor C1 flows in the gap G without passing through the resistor R. The current from the capacitor C1 is thus assumed to make a larger contribution to the flow of the capacitive current in the gap G during the discharge. Namely, wear of the center electrode 10 and the ground electrode 40 is suppressed by lowering the capacitance value of the capacitor C1. In particular, the distance between the first seal layer 16 and the metal shell 30 is short; and the space between the first seal layer 16 and the metal shell 30 is generally occupied by the insulator 20. In view of these points, the air layer of lower dielectric constant than that of the insulator 20 is provided to lower the capacitance value of the capacitor C1 and thereby suppress wear of the electrodes in the present embodiment. It is therefore possible to suppress wear of the electrodes by changing the thickness of the insulator 20, which is present between the first seal layer 16 and the metal shell 30, even though the influence of such an insulator thickness change on the other performance (such as heat resistance, fouling resistance, leakage resistance etc.) of the spark plug 100 is small.

B. Modifications

In the above embodiment, the parameters a and b are adjusted by cutting away the outer circumference of the insulator 20. The method for adjustment of the parameters a and b is not however limited to such cutting. It is alternatively feasible to adjust the parameters a and b by the following method.

Figure 8A:
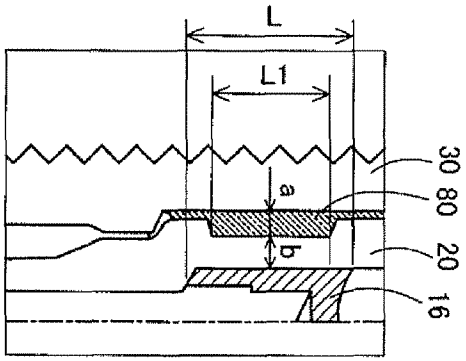
FIGS. 8(A), 8(B), 8(C) and 8(D) are schematic views showing other examples of how to adjust the parameters a and b.
Figure 8B:
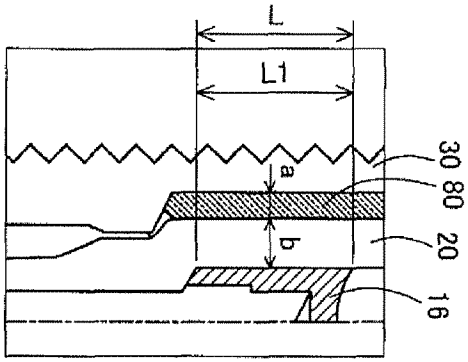
Figure 8C:
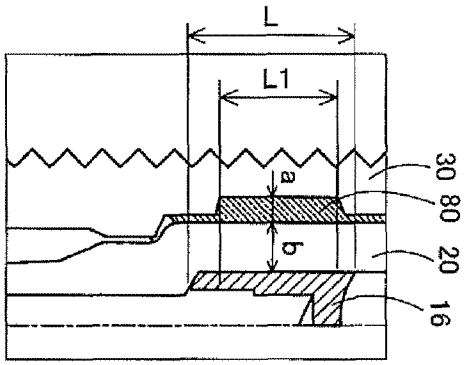
Figure 8D:
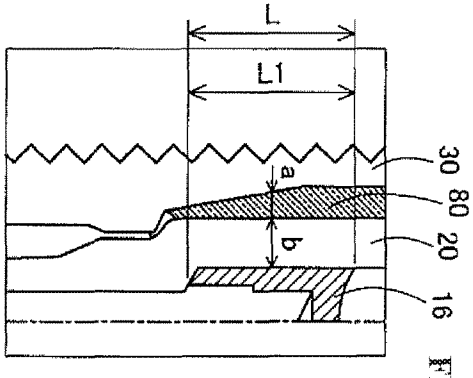

FIGS. 8(A), 8(B), 8(C) and 8(D) are schematic views showing other methods for adjustment of the parameters a and b. In FIG. 8(A), a part of the outer circumference of the insulator 20 is cut away without cutting a part of the outer circumference of the insulator 20 on the side of the interface between the first seal layer 16 and the resistor 17. In FIG. 8(B), the inner circumference of the metal shell 30 is cut away. In FIG. 8(C), a part of the inner circumference of the metal shell 30 is cut away without cutting a part of the inner circumference of the metal shell 30 on the side of the interface between the first seal layer 16 and the resistor 17. In FIG. 8(D), the inner circumference of the metal shell 30 is cut into a tapered shape. Alternatively, the outer circumference of the insulator 20 may be cut into a tapered shape.

The present invention is not limited to the above specific embodiment and modification example. Various changes and modifications can be made without departing from the scope of the present invention. For example, any of the technical features mentioned above in "Summary of the Invention" and "Description of the Embodiments" may be replaced or combined as appropriate in order to solve a part or all of the above-mentioned problems or achieve a part or all of the above-mentioned effects. Any of these technical features, if not explained as essential in the present specification, may be eliminated as appropriate.

DESCRIPTION OF REFERENCE NUMERALS

10: Center electrode
12: Electrode base material
14: Core material
15: Electrical connection part
16: First seal layer
17: Resistor
18: Second seal layer
19: Metal terminal
20: Insulator
22: Leg portion
24: First insulator body portion
25: Insulator collar portion
26: Second insulator body portion
28: Axial hole
30: Metal shell
31: End face
32: Thread portion
34: Body portion
35: Recessed portion
36: Tool engagement portion
38: Crimp portion
40: Ground electrode
50: Gasket
62: Packing
63: Filled portion
80: Air layer
100: Spark plug
200: Engine head
210: Mounting screw hole
C1: Capacitor
C2: Capacitor
G: Gap
L: Region
L1: Zone
O-O: Axis
R: Resistance Having described the invention, the following is claimed:

1. A spark plug comprising:

an insulator having an axial hole formed in a direction of an axis of the spark plug;

a center electrode held in one end side of the axial hole;

a metal terminal held in the other end side of the axial hole;

an electrical connection part arranged to establish electrical connection between the center electrode and the metal terminal within the axial hole; and a metal shell disposed around an outer circumference of the insulator and having a thread portion formed on at least a part of an outer circumferential surface thereof, wherein the electrical connection part includes: a resistor; and a conductive seal layer provided between the resistor and the center electrode to seal and fix the insulator and the center electrode together; and wherein, in a half or more of a region in which the seal layer is provided in the direction of the axis, the spark plug satisfies the following conditions: $a/(a+b)\times 100\geq 8.2$ and $a+b\geq 2.80$ in the case of M=14 mm; $a/(a+b)\times 100\geq 8.3$ and $a+b\geq 1.80$ in the case of M=12 mm; and $a/(a+b)\times 100\geq 8.6$ and $a+b\geq 1.75$ in the case of M=10 mm, where M represents a nominal diameter of the thread portion; a represents a distance between the insulator and the metal shell; and b represents a thickness of the insulator.

2. The spark plug according to claim 1, wherein the spark plug satisfies the following conditions: $a+b\geq 2.95$ in the case of M=14 mm; $a+b\geq 1.95$ in the case of M=12 mm; and $a+b\geq 1.90$ in the case of M=10 mm.

3. The spark plug according to claim 1, wherein the conditions are satisfied throughout the entire region in which the seal layer is provided.

4. The spark plug according to claim 1, wherein the nominal diameter of the thread portion is 10 mm or 12 mm.

* * * * *